US007159544B1

(12) United States Patent
Studdert et al.

(10) Patent No.: US 7,159,544 B1
(45) Date of Patent: Jan. 9, 2007

(54) INTERNAL COMBUSTION ENGINE WITH VARIABLE DISPLACEMENT PISTONS

(76) Inventors: Andrew P. Studdert, 2844 Blackhawk Rd., Wilmette, IL (US) 60091; Michael R. Miller, 248 Linden St., Winnetka, IL (US) 60093

( * ) Notice: Subject to any disclaimer, the term of this patent is extended or adjusted under 35 U.S.C. 154(b) by 0 days.

(21) Appl. No.: 11/244,847

(22) Filed: Oct. 6, 2005

(51) Int. Cl.
*F02B 75/04* (2006.01)

(52) U.S. Cl. ..... 123/48 B; 123/48 R

(58) Field of Classification Search ..... 123/48 R, 123/48 B
See application file for complete search history.

(56) References Cited

U.S. PATENT DOCUMENTS

| | | | |
|---|---|---|---|
| 364,627 | A | 6/1887 | Arnold |
| 441,947 | A | 12/1890 | Eickershoff |
| 976,858 | A | 11/1910 | Easthope, Jr. |
| 1,151,434 | A | 8/1915 | Appleton |
| 1,178,181 | A | 4/1916 | Rites |
| 1,673,775 | A | 6/1928 | Moore |
| 1,701,538 | A | 2/1929 | Moore |
| 2,067,453 | A | 1/1937 | Lee |
| 2,172,170 | A | 9/1939 | Megroot |
| 2,224,229 | A | 12/1940 | Miller |
| 3,183,900 | A | 5/1965 | Hellweg |
| 3,407,974 | A | 10/1968 | Chmielowiec |
| 4,131,094 | A | 12/1978 | Crise |
| 4,327,550 | A | 5/1982 | Knoos |
| 4,359,976 | A | 11/1982 | Steele |
| 4,627,795 | A | 12/1986 | Schmitz-Montz |
| 4,700,667 | A | 10/1987 | Ohna |
| 4,858,571 | A | 8/1989 | Yang |
| 4,864,826 | A | 9/1989 | Lagow |
| 4,913,323 | A | 4/1990 | Scheindel |
| 4,924,956 | A | 5/1990 | Deng et al. |
| 4,976,248 | A | 12/1990 | Rowe |
| 5,136,987 | A | 8/1992 | Schechter et al. |
| 5,167,208 | A | 12/1992 | Rasiah |
| 5,673,665 | A | 10/1997 | Kim |
| 5,694,891 | A | 12/1997 | Liebich |
| 5,813,383 | A | 9/1998 | Cummings |
| 5,862,781 | A | 1/1999 | Rossle |
| 6,065,440 | A | 5/2000 | Pasquan |
| 6,145,488 | A | 11/2000 | Plechner |
| 6,782,865 | B1 | 8/2004 | Rayl et al. |
| 6,810,840 | B1 | 11/2004 | Von Gaisberg-Helfenberg |

*Primary Examiner*—Noah P. Kamen
(74) *Attorney, Agent, or Firm*—Brinks Hofer Gilson & Lione

(57) ABSTRACT

An engine includes at least one cylinder bore having a cylinder wall and a piston positioned within the cylinder bore, and adapted for reciprocal movement therein. At least one piston sleeve is positioned within the cylinder bore, radially between the piston and the cylinder wall. The piston sleeve extends around the piston, and is adapted for reciprocal movement therein. The piston and the piston sleeve are able to move independently of one another. A stop selectively secures the piston sleeve stationary within the cylinder adjacent a top portion of the cylinder. When the stop is de-activated, the piston and the piston sleeve move together within the cylinder, and when the stop is activated, the piston sleeve is secured adjacent the top portion of the cylinder and the piston moves reciprocally within the piston sleeve.

17 Claims, 7 Drawing Sheets

INTERNAL COMBUSTION ENGINE WITH VARIABLE DISPLACEMENT PISTONS

BACKGROUND

1. Field of the Invention

The invention generally relates to an internal combustion engine having variable displacement. Specifically, the invention relates to an internal combustion engine having at least one core piston and at least one piston sleeve per core piston mounted within a cylinder to provide dynamic variable displacement.

2. Background of the Invention

Internal combustion engines used in cars, trucks, boats, and other motor vehicles are required to produce a wide range of power outputs. For example, when a car is accelerating, more power is required than when the car is cruising at a constant speed on the highway. When the car is cruising at constant speed, coasting, decelerating, idling, or starting up, much less power is needed. In conventional engines, additional unnecessary combustion is taking place at these times.

Engines have been developed to take advantage of this. For example, when an eight cylinder engine reaches cruising speed on the highway, and is no longer accelerating, the power needed to maintain the vehicle at that speed, on a flat, level road, is very small. So small, in fact, that the speed of the vehicle can be maintained with less than all of the cylinders firing. In an eight cylinder engine, all eight cylinders would be firing when the vehicle is undergoing high acceleration, such as when the vehicle is running up to speed at it enters a highway on-ramp, or when passing another vehicle on a two lane road. When the vehicle is cruising at constant speed on a level road, coasting, decelerating, idling, or starting up, only two or four of the cylinders would be necessary. The other four or six cylinders are shut down to conserve fuel. Likewise, when that vehicle encounters an incline in the roadway, more of the cylinders can be activated in order to maintain the vehicle's speed.

These engines require complicated controls to detect the driving conditions and to determine when and if cylinders within the engine should be shut down or activated.

Other engines use numerous valves or variable flow valves to increase or decrease the flow of air and fuel into the cylinders. In this type of engine, all of the cylinders are running all the time, but a computer determines how much power the engine needs to output, and adjusts the amount of fuel and air that are supplied to the cylinders accordingly. Thus, when the vehicle is accelerating, the flow or air and fuel to the cylinders would be increased, and when the vehicle is cruising at constant speed on a level roadway, the valves can be adjusted to reduce the amount of fuel and air flowing to the cylinders, or some of the valves may be shut off completely. This can cause problems because intermittent use of the valves can cause them to get "sticky", and not work properly.

Therefore, there is a need for a variable displacement engine that does not require cylinders to be shut down, and does not involve intermittent use of the valves.

SUMMARY

In one aspect an internal combustion engine of the present invention includes at least one cylinder bore having a cylinder wall, and a piston positioned within the cylinder bore. The piston is adapted for reciprocal movement within the cylinder bore. At least one piston sleeve is positioned within the cylinder bore. The piston sleeve is positioned radially between the piston and the cylinder wall, extends around the piston, and is adapted for reciprocal movement within the cylinder bore. The piston and the piston sleeve are able to move independently of one another. The cylinder includes a stop for selectively securing the piston sleeve stationary within the cylinder adjacent a top portion of the cylinder. When the stop is de-activated, the piston and the piston sleeve move together within the cylinder. When the stop is activated, the piston sleeve is secured adjacent the top portion of the cylinder and the piston moves reciprocally within the piston sleeve.

In another aspect, the piston and the piston sleeve each have a top surface. The top portion of the cylinder includes at least one inlet valve, adapted to allow air or fuel to flow therethrough, and at least one outlet valve, adapted to allow exhaust to flow therethrough. The piston, the piston sleeve, the cylinder wall, and the top portion of the cylinder define a combustion chamber. The inlet and the outlet valves are in fluid communication with the combustion chamber. When the stop is activated, and the piston sleeve is held adjacent the top portion of the cylinder, the combustion chamber is defined by an inner surface of the piston sleeve, the top portion of the cylinder, and the top surface of the piston. Alternatively, when the stop is de-activated, and the piston sleeve moves with the piston within the cylinder, the combustion chamber is defined by the cylinder wall, the top portion of the cylinder, and the top surfaces of the piston and the piston sleeve.

In yet another aspect, the top portion of the cylinder includes a spark device adapted to produce a spark for igniting the fuel and air that are injected within the combustion chamber. The inlet valves, the outlet valves, and the spark device are positioned axially in line with the top surface of the piston, such that the inlet valves, the outlet valves, and the spark device are all positioned within the combustion chamber when the stop is activated.

In still another aspect, the piston includes radially projecting features, such as a radial flange. The radial flange "catches" the piston sleeve such that the piston sleeve is supported thereon and moves reciprocally within the cylinder when the stop is de-activated.

In yet another aspect, the piston sleeve includes at least one groove formed within an outer surface thereof. At least one ring is positioned within the groove to form a substantially sealed sliding engagement between the outer surface of the piston sleeve and the cylinder wall. The piston also includes at least one groove formed within an outer surface thereof, and includes a ring positioned therein to form a substantially sealed sliding engagement between the outer surface of the piston and an inner surface of the piston sleeve. The piston includes at least one more groove and one more ring than the piston sleeve, thereby creating more friction between the pistion and the inner surface of the piston sleeve than between the piston sleeve and the cylinder wall. This insures that when the stop is de-activated, friction between the pistion and the inner surface of the piston sleeve will cause the piston sleeve to move with the piston.

In still yet another aspect, the stop comprises an electromagnetic coil. The electromagnetic coil is mounted within a housing, and positioned outside the cylinder adjacent the top portion of the cylinder. The electromagnetic coil is adapted to produce a focused magnetic flux to magnetically attract and hold the piston sleeve against the top portion of the cylinder. A non magnetic ring may be positioned between the electromagnetic coil and the cylinder. The non-magnetic ring extends across a portion of the width of the electromagnetic coil such that the magnetic flux created by the electromagnetic coil travels around the non-magnetic ring.

DESCRIPTION OF THE DRAWINGS

The above, as well as other advantages of the present invention, will become readily apparent to those skilled in the art from the following detailed description of a preferred embodiment when considered in the light of the accompanying drawings.

DESCRIPTION OF THE EMBODIMENTS

Figure 1:
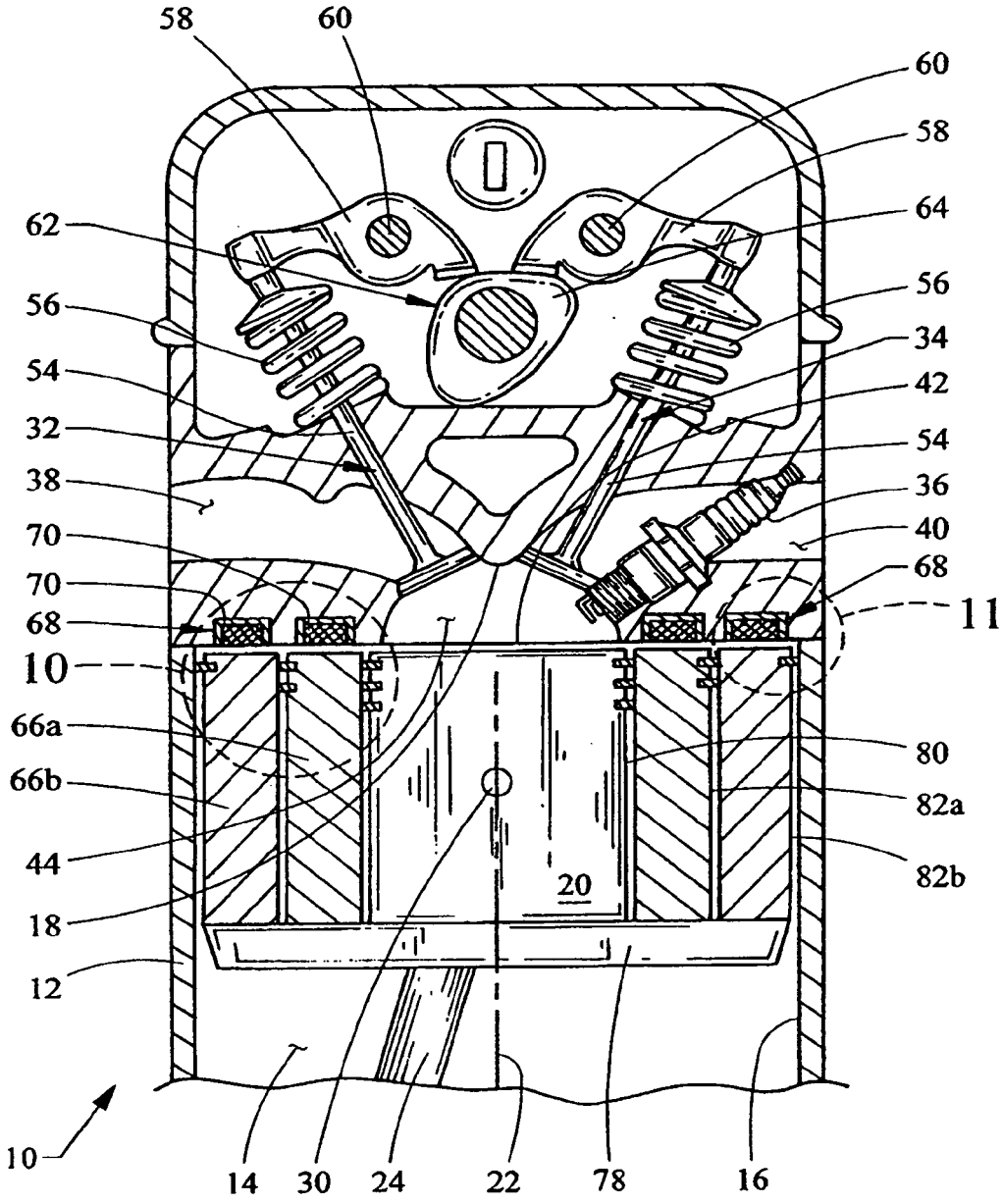
FIG. 1 is a sectional view of a piston cylinder for an internal combustion engine having a piston with two piston sleeves in accordance with the present invention.

Referring to FIG. 1, one cylinder of an internal combustion engine of the present invention is shown generally at 10. The engine could contain any suitable number of such cylinders, such as a four, six, eight, or even ten cylinder engine, which are commonly known. The concepts of the present invention are applicable to any type of internal combustion engine, including gasoline engines, diesel engines, or any engine incorporating reciprocating pistons.

The internal combustion engine includes an engine block 12 and a plurality of cylinder bores 14 are formed therein. Each cylinder bore 14 is generally cylindrical in shape and defines a cylinder wall 16 and a top portion 18. A piston 20 is positioned within the cylinder bore 14 and is adapted for reciprocal linear movement therein along an axial axis 22 of the cylinder bore 14. A connecting rod 24 is positioned between and interconnects the piston 20 to a crankshaft (not shown). The connecting rod 24 is pivotally connected to the crankshaft at a distance from a central axis of the crankshaft. The piston 20 is pivotally connected to the connecting rod 24 via a diametrically arranged wrist pin 30, such that reciprocal linear motion of the piston 20 is translated, through the connecting rod 24, to rotational motion of the crankshaft. The crankshaft is in turn connected to the transmission (not shown) and other power train components of the vehicle to provide power to the drive wheels of the vehicle.

The top portion 18 of the cylinder bore 14 includes an inlet valve 32, an outlet valve 34, and a spark device, such as a spark plug 36, positioned therein. The inlet valve 32 is adapted to selectively allow fluid communication between an inlet passageway 38 and the cylinder bore 14, and the outlet valve 34 is adapted to selectively allow fluid communication between an outlet passageway 40 and the cylinder bore 14.

Figure 2:
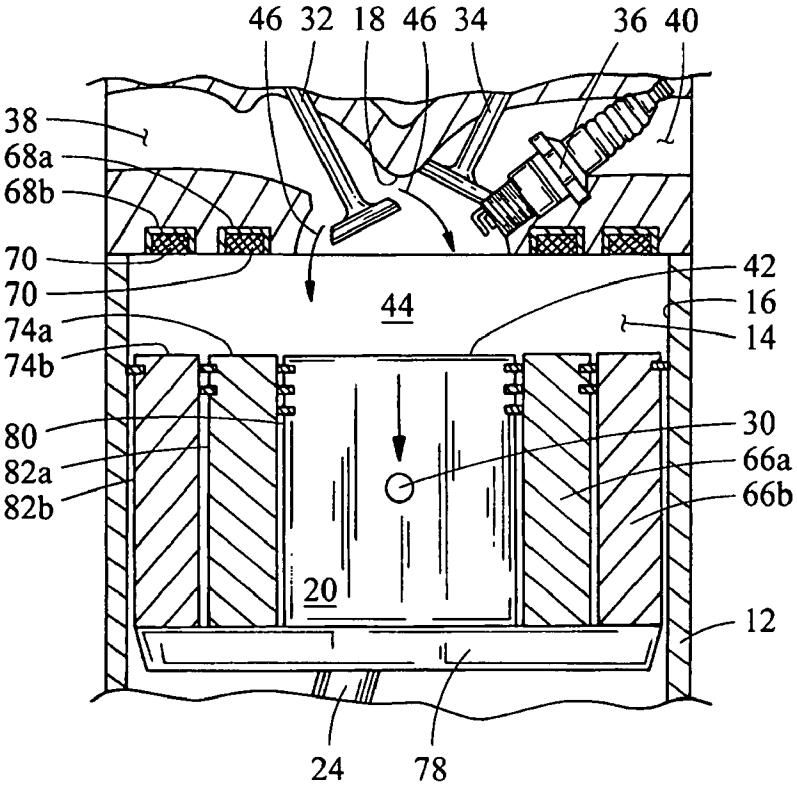
FIG. 2 is a sectional view similar to FIG. 1, wherein the inlet valve is open and fuel and air are entering the combustion chamber.

A top surface 42 of the piston 20, the cylinder wall 16, and the top portion 18 of the cylinder bore 14 define a combustion chamber 44. Referring to FIG. 2, as the piston 20 moves downward, away from the top portion 18 of the cylinder bore 14, the inlet valve opens, and fuel and air are supplied to the combustion chamber from the inlet passageway through the open inlet valve 32, as shown by arrows 46.

Figure 3:
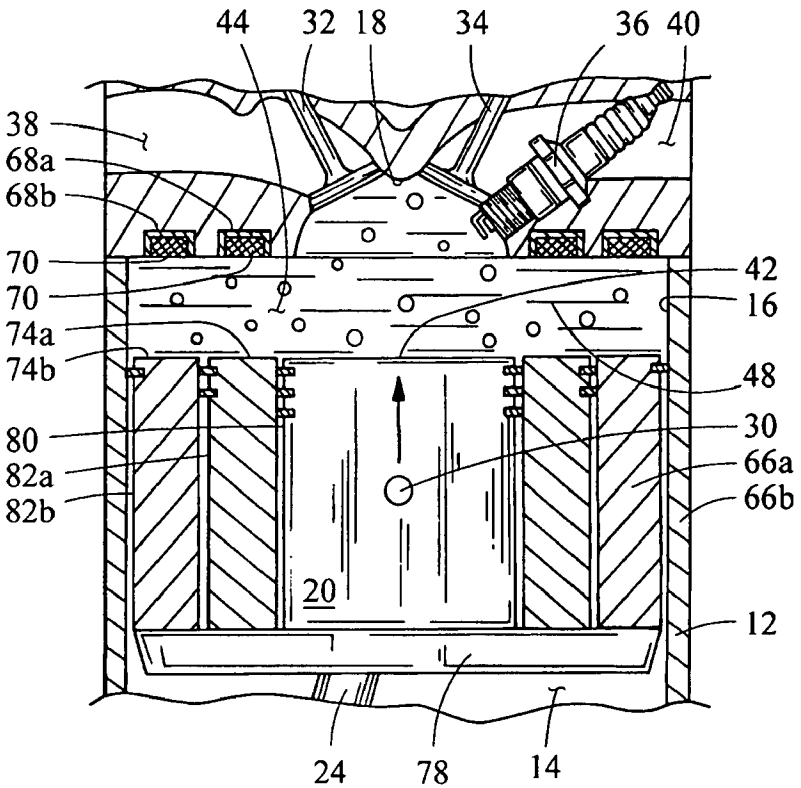
FIG. 3 is a sectional view similar to FIG. 1, wherein the inlet valve and outlet valve are closed and the piston is compressing the fuel and air mixture within the combustion chamber.
Figure 4:
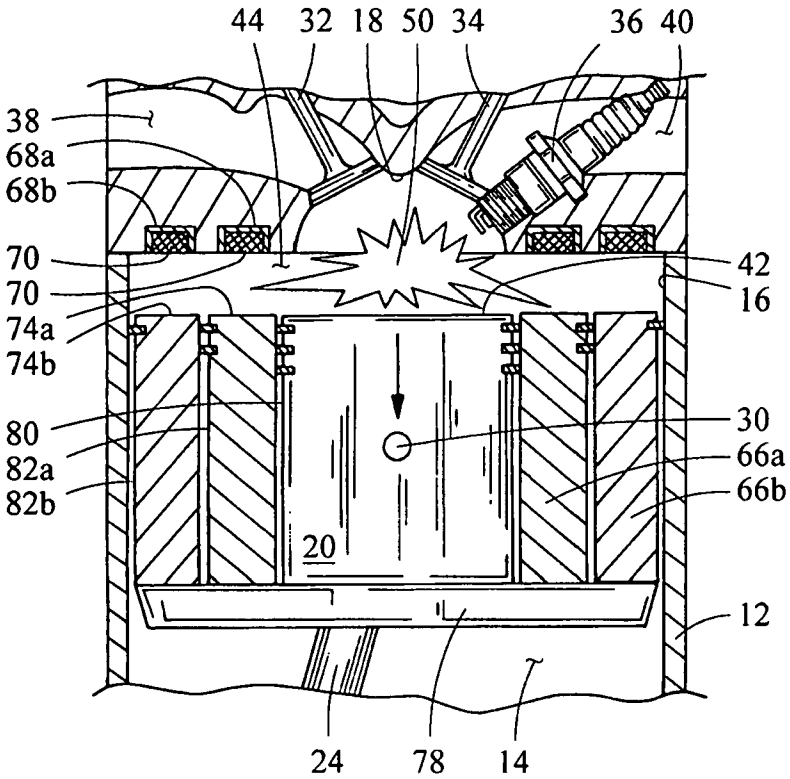
FIG. 4 is a sectional view similar to FIG. 1, wherein the inlet valve and the outlet valve are closed, and a spark causes the fuel and air mixture to explode within the combustion chamber.

Referring to FIG. 3, when the piston 20 reaches the bottom of the stroke, the piston 20 begins to move upward toward the top portion 18 of the cylinder bore 14. When this happens, the inlet valve 32 closes, sealing the combustion chamber 44. As the piston 20 moves upward, the combustion chamber 44 becomes smaller, and the fuel and air mixture 48 within the combustion chamber 44 are compressed. When the piston 20 reaches the top of the stroke, the spark plug 36 produces a spark within the combustion chamber 44 that ignites the fuel and air mixture 48 therein to cause an explosion 50 within the combustion chamber 44. This explosion 50 produces a rapid a violent expansion of gases within the combustion chamber 44 that force the piston 20 downward, away from the top portion 18 of the cylinder bore 14, as shown in FIG. 4.

Figure 5:
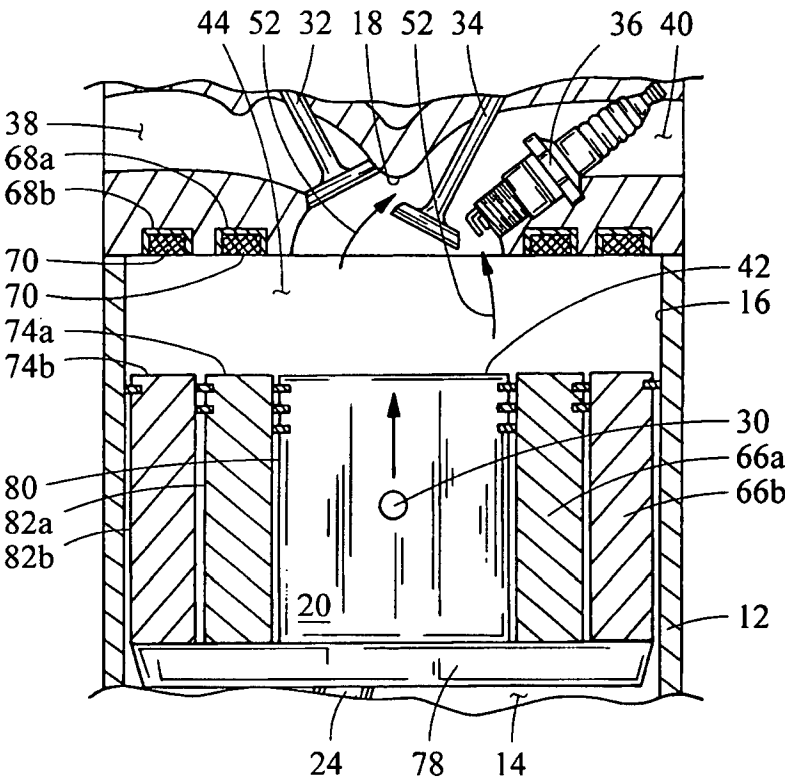
FIG. 5 is a sectional view similar to FIG. 1, wherein the outlet valve is open allowing gases within the combustion chamber to be forced outward by the upward moving piston.

Referring to FIG. 5, when the piston 20 once again reaches the bottom of the stroke, the piston 20 begins to move upward again toward the top portion 18 of the cylinder bore 14. When this happens, the outlet valve 34 is opened. As the piston 20 moves upward, and the size of the combustion chamber 44 is reducing, the gases remaining within the combustion chamber 44 are forced out through the outlet valve 34 to the outlet passageway 40, as shown by arrows 52. These gases are carried away from the engine and exhausted through the exhaust system (not shown) of the vehicle.

When the piston reaches the top of this stroke, and begins to move downward, away from the top portion 18 of the cylinder bore 14 again, the outlet valve 34 closes, the inlet valve 32 opens to allow fresh fuel and air to enter the combustion chamber 44 and the cycle starts again, as shown in FIG. 2.

The opening and closing of the and the inlet and outlet valves 32, 34 is carefully controlled and timed. Each valve 32, 34 includes an elongated stem 54 that is connected to a spring 56 that biases the valve 32, 34 to the closed position. A pivoting rocker arm 58 is connected to a distal end of each stem 54. The rocker arms 58 pivot about a pivot point 60 that is laterally spaced from the stem 54. A cam shaft 62 having radially extending lobes 64 spaced circumferentially and axially along and around the cam shaft 62 is positioned in engagement with each of the rocker arms 58.

Each rocker arm 58 is aligned with a lobe 64 of the cam shaft 62, such that, as the cam shaft 62 rotates, each time a lobe 64 rotates around and contacts the rocker arm 58, the rocker arm 58 pivots and pushes the stem 54 of the valve 32, 34 to overcome the biasing spring 56, and open the valve 32, 34. Careful timing of the rotation of the cam shaft 62, and placement of the lobes 64, provides proper timing of the opening and closing of the inlet and outlet valves 32, 34.

At least one piston sleeve 66 is positioned within the cylinder bore 14. Referring to FIGS. 1–5, two piston sleeves 66*a*, 66*b* are positioned radially between the piston 20 and the cylinder wall 14. The piston sleeves 66*a*, 66*b* are generally cylindrical in shape and have a hollow tube structure. A first piston sleeve 66*a* is positioned around the piston 20, and a second piston sleeve 66*b* is positioned around the first piston sleeve 66*a*. The first and second piston sleeves 66*a*, 66*b* are adapted to reciprocally move within the cylinder bore 14 independently of each other and the piston 20.

The cylinder 10 includes a stop 68 for each piston sleeve 66 within the cylinder bore 14. The stops 68 are adapted to selectively stop the piston sleeve 66 from reciprocal linear movement within the cylinder bore 14 and to hold the piston sleeve 66 against the top portion 18 of the cylinder bore 14.

Referring to FIGS. 1–5 and 11, the stops 68 comprise electromagnetic coils 70 that are adapted to produce a magnetic flux 72 to magnetically attract and hold the piston sleeves 66 against the top portion 18 of the cylinder bore 14. The stops 68 are positioned outside the cylinder bore 14 adjacent the top portion 18 of the cylinder bore 14. A first stop 68*a* is positioned axially aligned with the first piston sleeve 66*a*, and a second stop 68*b* is positioned axially aligned with the second piston sleeve 66*b*. When a stop 68 is activated, the piston sleeve that is aligned with that stop 68 is held against the top portion 18 of the cylinder bore 14, thereby reducing the size of the combustion chamber 44. It should be understood, that other types of electrical, or mechanical stops could be used to selectively secure the piston sleeves 66*a*, 66*b* against the top portion 18 of the cylinder bore 14 without departing from the scope of the present invention.

When the stops 68*a*, 68*b* are not activated, both the first and second piston sleeves 66*a*, 66*b* are allowed to move within the cylinder bore 14 as shown in FIGS. 1–5. In this instance, the combustion chamber 44 is defined by the cylinder wall 16 and the top portion 18 of the cylinder bore 14, the top surface 42 of the piston 20, and top surfaces 74*a*, 74*b*, of the first and second piston sleeves 66*a*, 66*b* respectively. This provides the largest possible combustion chamber 44, thereby providing the most power output. When the engine is running under high load conditions, such as acceleration or towing, both of the stops 68*a*, 68*b* would de-activated, thereby allowing both piston sleeves 66*a*, 66*b* to move with the piston 20, and providing the largest possible combustion chamber 44.

Figure 7:
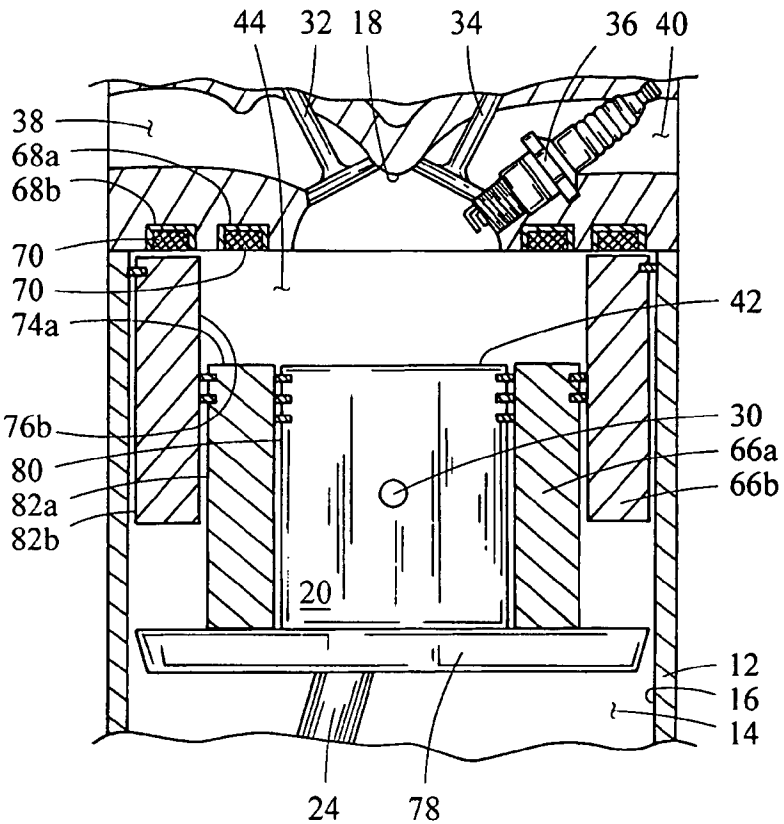
FIGS. 6 and 7 are sectional views similar to FIG. 1, wherein one of the piston sleeves moves with the piston and the other piston sleeve is secured stationary within the cylinder.
Figure 6:
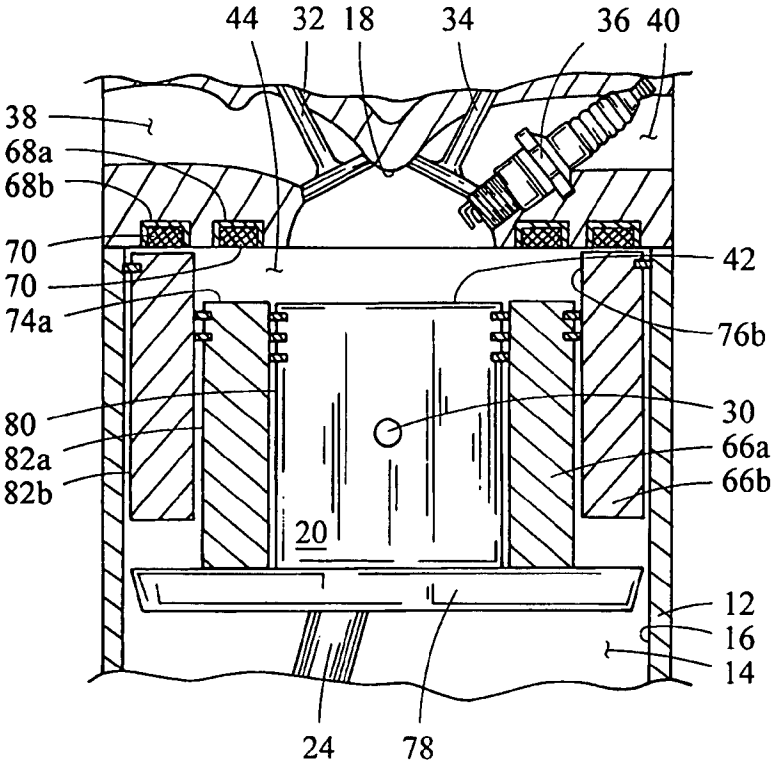

Referring to FIGS. 6 and 7, when the second stop 68*b* is activated, the second piston sleeve 66*b* is held against the top portion 18 of the cylinder bore 14. As the piston 20 moves downward away from the top portion 18 of the cylinder bore 14, the first piston sleeve 66*a* moves along with the pistion 20, however the second piston sleeve 66*b* is held securely against the top portion 18 of the cylinder bore 14, as shown in FIG. 6. In this instance, the combustion chamber 44 is defined by the top portion 18 of the cylinder bore 14, the top surface 42 of the piston 20, the top surface 74*a* of the first piston sleeve 66*a*, and an inner surface 76*b* of the second piston sleeve 66*b*, as shown in FIG. 7. The combustion chamber 44 is smaller due to the volume filled by the second piston sleeve 66*b*. The smaller combustion chamber 44 is suitable for producing less power output, such as when the vehicle is moving up a slight incline, or accelerating modestly.

Figure 9:
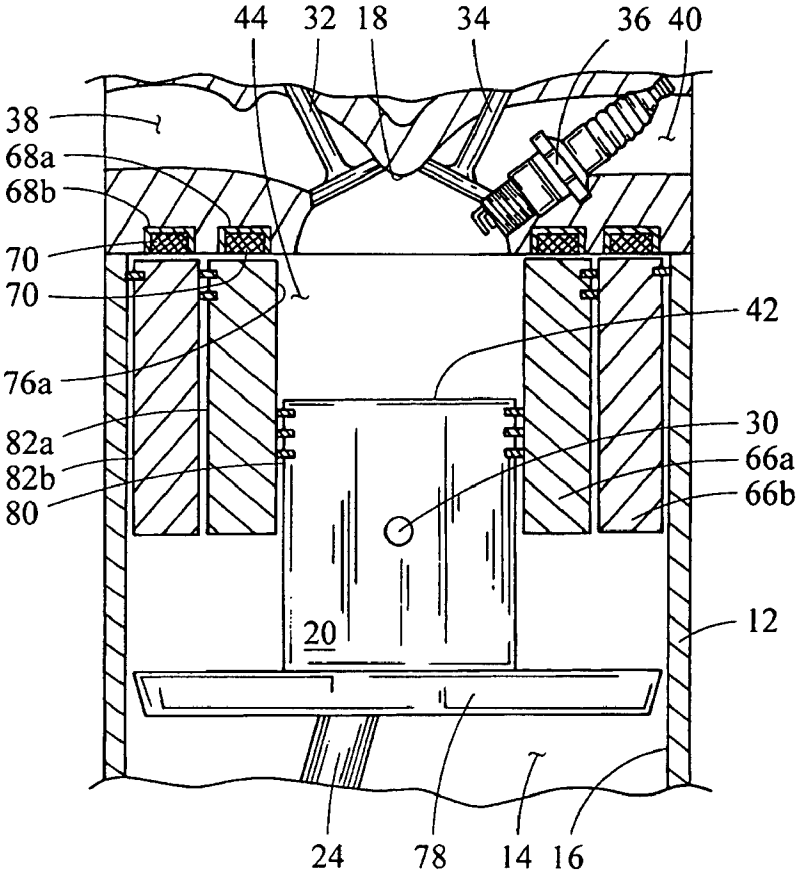
FIGS. 8 and 9 are sectional views similar to FIG. 1, wherein both of the piston sleeves are secured stationary within the cylinder and only the piston moves reciprocally therein.
Figure 8:
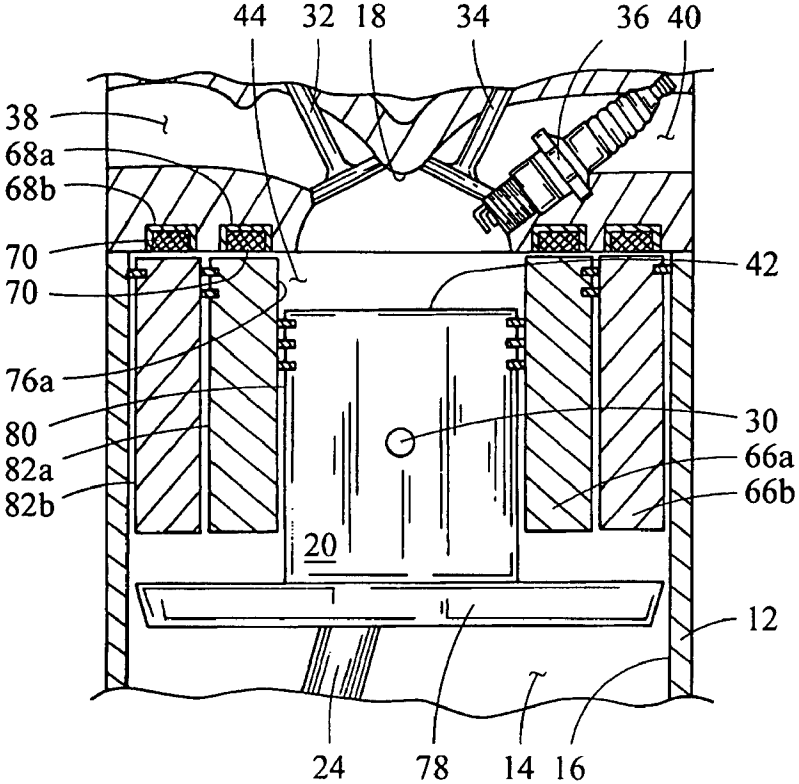

Referring to FIGS. 8 and 9, when the first and second stops 68*a*, 68*b* are activated, the first and second piston sleeves 66*a*, 66*b* are held against the top portion 18 of the cylinder bore 14. The piston 20 moves downward away from the top portion 18 of the cylinder bore 14, however the first and second piston sleeves 66*a*, 66*b* are held securely against the top portion 18 of the cylinder bore 14, as shown in FIG. 8. In this instance, the combustion chamber 44 is defined by the top portion 18 of the cylinder bore 14, the top surface 42 of the piston 20, and an inner surface 76*a* of the first piston sleeve 66*a*, as shown in FIG. 9. The combustion chamber 44 is even smaller due to the volume filled by the first and second piston sleeves 66*a*, 66*b*. The smaller combustion chamber 44 is suitable for producing still less power output, such as when the vehicle is idling, or cruising at a constant speed on a level roadway.

Referring to FIGS. 1–9, the inlet valve 32, the outlet valve 34, and the spark plug 36 are all axially aligned with the piston 20. This insures that even when both of the piston sleeves 66*a*, 66*b* are held against the top portion 18 of the cylinder bore 14, that the inlet and outlet valves 32, 34 and the spark plug 36 will be in fluid communication with the combustion chamber 44.

The piston 20 includes radially projecting features 78 that support the piston sleeves 66*a*, 66*b* when the piston sleeves 66*a*, 66*b* are moving along with the piston 20. As shown, the radially projecting features 78 comprise a radial flange extending radially outward and circumferentially around the piston 20.

Figure 10:
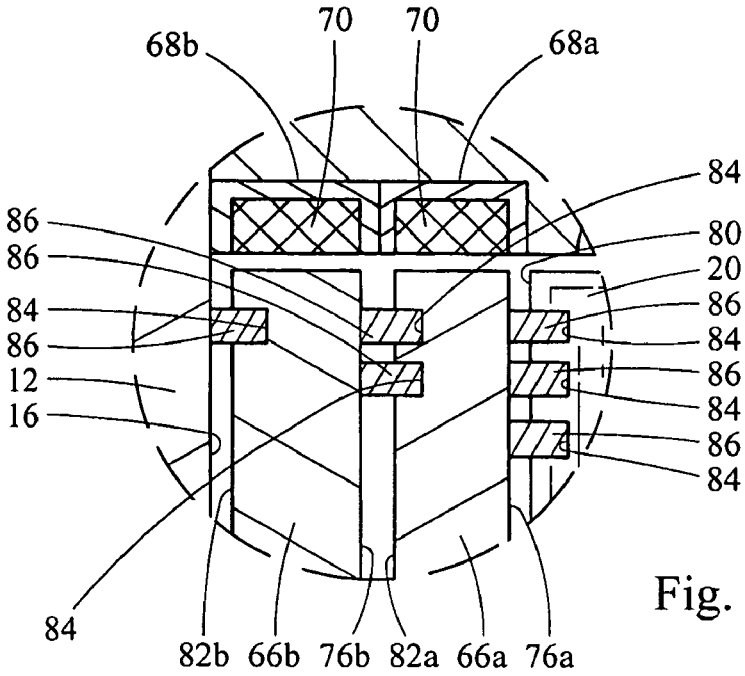
FIG. 10 is an enlarged portion of FIG. 1 as indicated by the circle labeled "FIG. 10" in FIG. 1.

The piston 20 and each piston sleeve 66*a*, 66*b* include an outer surface, 80, 82*a*, 82*b* respectively. The outer surface 80, 82*a*, 82*b* of the piston 20, and each piston sleeve 66*a*, 66*b* include a radial groove 84 formed therein that is adapted to receive a ring 86. Referring to FIG. 10, the outer surface 80 of the piston 20, includes three radial grooves 84 formed therein. A ring 86 is positioned within each groove 84 to form a sliding seal between the piston 20 and the inner surface 76*a* of the first piston sleeve 66*a*. The outer surface 82*a* of the first piston sleeve 66*a* includes two radial grooves 84 formed therein. A ring 86 is positioned within each groove 84 to form a sliding seal between the first piston sleeve 66*a* and the inner surface 76*b* of the second piston sleeve 66*b*. Finally, the outer surface 82*b* of the second piston sleeve 66*b* includes a radial groove 84 formed therein. A ring 86 is positioned within the groove 84 to form a sliding seal between the second piston sleeve 66*b* and the cylinder wall 16.

The rings 86 provide a sliding seal between the piston 20, the first and second piston sleeves 66*a*, 66*b*, and the cylinder wall 16 to prevent oil from the crankcase from leaking into the combustion chamber 44, and to prevent the fuel and air mixture and gases from the combustion chamber 44 from leaking into the crankcase. It may be favorable for the piston 20 to include at least one more groove 84 and one more ring 86 than the first piston sleeve 66*a*, and for the first piston sleeve 66*a* to include at least one more groove 84 and one more ring 86 than the second piston sleeve 66*b*.

This will provide more friction between the piston 20 and the inner surface 76*a* of the first piston sleeve 66*a* than between the first piston sleeve 66*a* and the inner surface 76*b* of the second piston sleeve 66*b*, such that when the first second piston sleeve 66*b* is held against the top portion 18 of the cylinder bore 14, the friction between the piston 20 and the inner surface 76*a* of the first piston sleeve 66*a* will overcome the friction between the first piston sleeve 66*a* and the inner surface 76*b* of the second piston sleeve 66*b*, and allow the first piston sleeve 66*a* to move reciprocally along with the piston 20.

Likewise, the friction between the first piston sleeve 66*a* and the inner surface of the second piston sleeve 66*b* will be more than the friction between the second piston sleeve 66*b* and the cylinder wall 16, such that when both of the stops 68*a*, 68*b* are de-activated and, the friction between the first piston sleeve 66*b* and the inner surface 76*b* of the second piston sleeve 66*b* will overcome the friction between the second piston sleeve 66*b* and the cylinder wall 16, and allow the second piston sleeve 66*b* to move reciprocally along with the first piston sleeve 66*a* an the piston 20.

Figure 11:
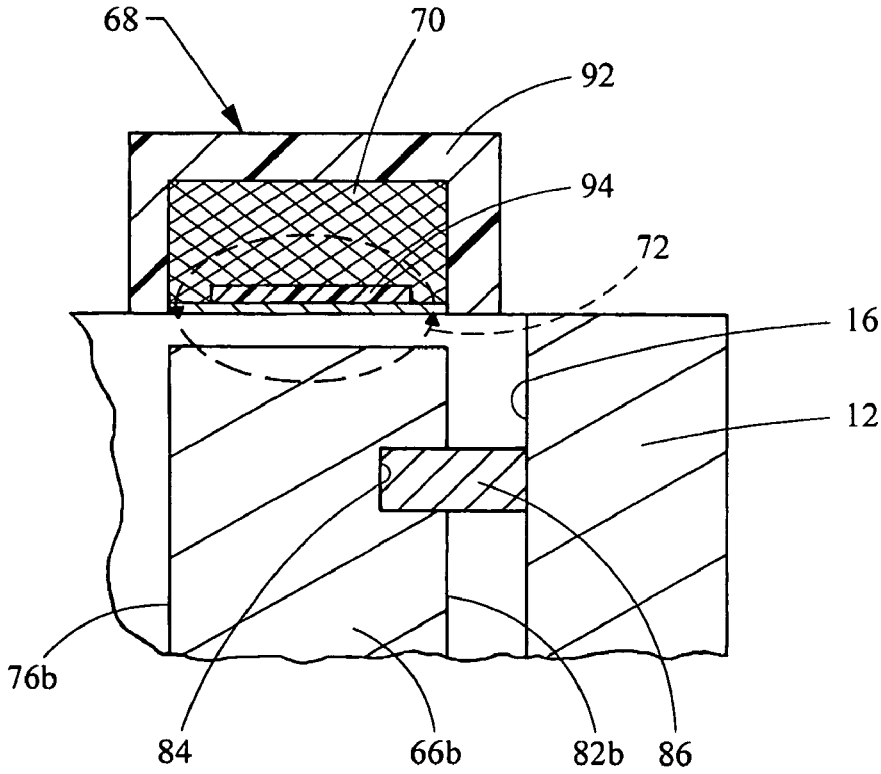
FIG. 11 is an enlarged portion of FIG. 1 as indicated by the circle laveled "FIG. 11" in FIG. 1.

Referring to FIG. 11, as previously mentioned, the stop 68 can comprise an electromagnetic coil 70. The electromagnetic coil 70 is mounted within a housing 92 that is mounted exterior to the cylinder bore 14 and adjacent the top portion 18 of the cylinder bore 14. The electromagnetic coil 70 is adapted to produce a magnetic flux 72 that will pass from the electromagnetic coil 70 into the piston sleeve 66, and back into the electromagnetic coil 70. This magnetic flux 72 will magnetically attract and hold the piston sleeve 66 against the top portion 18 of the cylinder bore 14.

It may be advantageous to place a non-magnetic ring 94 between the electromagnetic coil 70 and the top portion 18 of the cylinder bore 14. The non-magnetic ring 94 would extend across a portion of the width of the electromagnetic coil 70 such that the magnetic flux 72 created by the electromagnetic coil 70 travels around the non-magnetic ring 94.

It is important to insure that the piston sleeves 66*a*, 66*b* move along with the piston 20 during the downward stroke of the piston 20 when the electromagnetic coils 70 are de-activated. When one or both of the electromagnetic coils 70 are de-activated, the piston sleeves 66*a*, 66*b* are meant to move reciprocally with the piston 20. In order to assist in this movement, the current within the electromagnetic coils 70 can be reversed such that the flux 72 produced by the electromagnetic coils 70 pushes the piston sleeves 66*a*, 66*b* away from the top portion 18 of the cylinder bore 14.

The reversed magnetic flux 72, and the friction between the piston sleeves 66*a*, 66*b* and the rings 86 will get the piston sleeves 66*a*, 66*b* moving in the right direction, and create a gap between the top surfaces 74*a*, 74*b* of the piston sleeves 66*a*, 66*b* and the top portion 18 of the cylinder bore 14. If there is a gap between the top surfaces 74*a*, 74*b* of the piston sleeves 66*a*, 66*b* and the top portion 18 of the cylinder bore 14, at the time of combustion, then the combustion of the fuel and air mixture within the combustion chamber 44 will push the piston sleeves 66*a*, 66*b* downward, along with the piston 20.

Figure 12:
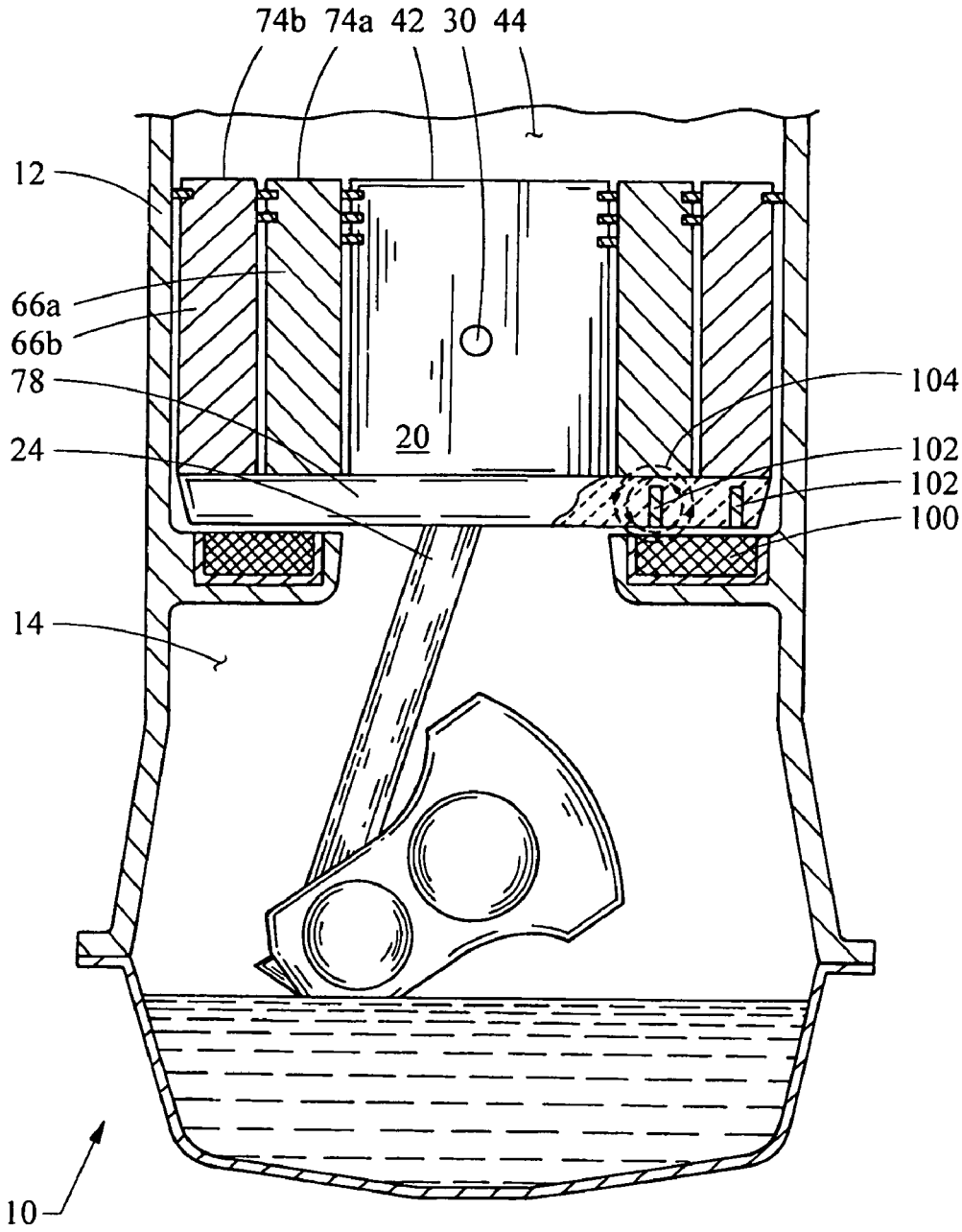
FIG. 12 is a side sectional view of a piston cylinder having electromagnetic coils mounted below the piston to assist in keeping the piston sleeves held down against the radially projecting flange.

Additionally, a magnetic coil 100 can be mounted stationary within the cylinder bore 14, below the low point of the piston stroke, to provide a magnetic flux to pull the piston sleeves 66*a*, 66*b* downward into solid contact with the radial flange 78 of the piston 20. Referring to FIG. 12, a magnetic coil 100 is positioned immediately below the lowest point in the piston stroke such that when the piston 20 reaches the lowest point of the stroke, the magnetic coil 100 is immediately adjacent the radial flange 78 of the piston 20. Within the radial flange 78 is a conductor ring 102. The conductor ring 102 is adapted to provide a path for a magnetic flux 104 similar to the magnetic flux 72 described above. This magnetic flux 104 will act to magnetically pull the piston sleeves 66*a*, 66*b* downward against the radial flange 78 whenever the radial flange 78 is within range of the magnetic flux 104. This will provide an additional force to help maintain the piston sleeves 66*a*, 66*b* in solid contact with the radial flange 78 of the piston 20 as the piston 20 reaches the bottom of the piston stroke and begins to move upward toward the top portion 18 of the cylinder bore 14.

In accordance with the provisions of the patent statutes, the present invention has been described in what is considered to represent its preferred embodiment. However, it should be noted that the invention can be practiced otherwise than as specifically illustrated and described.

What is claimed is:

1. An engine comprising:

at least one cylinder bore having a cylinder wall;

a piston positioned within the cylinder bore and adapted for reciprocal movement therein;

at least one piston sleeve positioned within the cylinder bore, radially between the piston and the cylinder wall, extending around the piston, and adapted for reciprocal movement therein, the piston and the piston sleeve being able to move independently of one another;

a stop for selectively securing the piston sleeve stationary within the cylinder adjacent a top portion of the cylinder, wherein when the stop is de-activated, the piston and the piston sleeve move together within the cylinder, and when the stop is activated, the piston sleeve is secured adjacent the top portion of the cylinder and the piston moves reciprocally within the piston sleeve.

2. The engine of claim 1, wherein the piston and the piston sleeve each have a top surface and the top portion of the cylinder includes at least one inlet valve and at least one outlet valve, the piston, the piston sleeve, the cylinder wall, and the top portion of the cylinder defining a combustion chamber, the inlet and outlet valves being in fluid communication with the combustion chamber.

3. The engine of claim 2, wherein when the stop is activated, and the piston sleeve is held adjacent the top portion of the cylinder, the combustion chamber is defined by an inner surface of the piston sleeve, the top portion of the cylinder, and the top surface of the piston, and when the stop is de-activated, and the piston sleeve moves with the piston within the cylinder, the combustion chamber is defined by the cylinder wall, the top portion of the cylinder, and the top surfaces of the piston and the piston sleeve.

4. The engine of claim 2 wherein the top portion of the cylinder includes an inlet valve for air, an inlet valve for fuel, and an outlet valve for exhaust.

5. The engine of claim 4, wherein the top portion of the cylinder includes a spark device adapted to produce a spark for igniting the fuel and air that are injected within the combustion chamber through the inlet valves.

6. The engine of claim 5, wherein the inlet valves, the outlet valves, and the spark device are positioned axially in line with the top surface of the piston, such that the inlet valves, the outlet valves, and the spark device are all positioned within the combustion chamber when the stop is activated.

7. The engine of claim 1, wherein the piston includes radially projecting features, the piston sleeve being supported on the radially projecting features such that the piston sleeve moves reciprocally within the cylinder when the stop is de-activated.

8. The engine of claim 7, wherein the radially projecting features comprise a radial flange extending circumferentially around the piston.

9. The engine of claim 1, wherein the piston sleeve includes at least one groove formed within an outer surface thereof, at least one ring being positioned within the groove to form a substantially sealed sliding engagement between the outer surface of the piston sleeve and the cylinder wall.

10. The engine of claim 9, wherein the piston includes at least one groove formed within an outer surface thereof, at least one ring being positioned within the groove to form a substantially sealed sliding engagement between the outer surface of the piston and an inner surface of the piston sleeve.

11. The engine of claim 10, wherein the piston includes at least one more groove and one more ring than the piston sleeve, thereby creating more friction between the pistion and the inner surface of the piston sleeve than between the piston sleeve and the cylinder wall, such that when the stop is de-activated, friction between the piston and the piston sleeve will cause the piston sleeve to move with the piston.

12. The engine of claim 1, wherein the engine is a gasoline engine.

13. The engine of claim 1, wherein the engine is a diesel engine.

14. The engine of claim 1, wherein the stop comprises an electromagnetic coil, mounted within a housing, and positioned outside the cylinder adjacent the top portion of the cylinder, the electromagnetic coil adapted to produce a focused magnetic flux to magnetically attract and hold the piston sleeve against the top portion of the cylinder.

15. The engine of claim 14, further including a non magnetic ring positioned between the electromagnetic coil and the cylinder, the non-magnetic ring extending across a portion of the width of the electromagnetic coil such that the magnetic flux created by the electromagnetic coil travels around the non-magnetic ring.

16. The engine of claim 14, further including an device mounted within the cylinder bore adapted to provide a force to maintain the piston sleeves such that the piston sleeves move reciprocally with the piston.

17. The engine of claim 16, further including an electromagnetic coil mounted within the cylinder bore, the magnetic coil being adapted to produce a magnetic flux to maintain the piston sleeves such that the piston sleeves move reciprocally with the piston.

* * * * *